United States Patent [19]

Kovaleski

[11] 4,055,314

[45] Oct. 25, 1977

[54] WIRE PAY-OFF CAP ASSEMBLY FOR WIRE SPOOLS

[75] Inventor: Joseph J. Kovaleski, Easton, Conn.

[73] Assignee: Wyrepak Industries, Inc., Bridgeport, Conn.

[21] Appl. No.: 725,095

[22] Filed: Sept. 17, 1976

[51] Int. Cl.[2] ..... B65H 49/00

[52] U.S. Cl. ..... 242/128; 242/147 R

[58] Field of Search ..... 242/128, 129.72, 129.8, 242/147 R, 155 R; 57/34 R, 58.83, 58.86; 139/122 R; 66/132 R

[56] References Cited

U.S. PATENT DOCUMENTS

| | | | |
|---|---|---|---|
| 2,338,539 | 1/1944 | Quinlan | 242/128 |
| 2,377,799 | 6/1945 | Markwood | 242/128 |
| 3,791,119 | 2/1974 | Godderidge | 57/34 R |
| 3,972,489 | 8/1976 | Kovaleski | 242/128 |
| 3,995,786 | 12/1976 | DeNiega | 242/47.01 |

*Primary Examiner*—Leonard D. Christian
*Attorney, Agent, or Firm*—H. Gibner Lehmann; K. Gibner Lehmann

[57] ABSTRACT

A wire pay-off cap assembly for use with wire-filled, flanged spools for controlling the unreeling of wire past the ends thereof, comprising a support member carried by the spool, a stationary circular tension brush mounted on the support member, and a freely rotatable wheel carried by a ball bearing assemblage on the member. The wheel is constituted as two separate pieces, one piece comprising a disk-like body mounted at its center on the bearing, and the other piece comprising an annular wheel flange having a concave cross-section providing a curved exterior surface for sliding contact with a strand of the wire being unreeled. Co-operable means are provided on the body and flange for releasably securing the two together such that the flange, when worn or damaged, can be readily replaced without removing the body from the support member. The body is preferably constituted of molded plastic to keep the overall weight down, with the flange being constituted of anodized aluminum to provide a light-weight, abrasion resistant surface for engagement with the wire being unreeled.

9 Claims, 5 Drawing Figures

WIRE PAY-OFF CAP ASSEMBLY FOR WIRE SPOOLS

CROSS REFERENCES TO RELATED APPLICATIONS AND PATENTS

U.S. Pat. No. 3,425,647, issued Feb. 4, 1969 to Joseph J. Kovaleski, and entitled "Wire Take-Off Device".

Applicant's co-pending application, U.S. Ser. No. 563,792, filed Mar. 31, 1975, and entitled "Spool Handling Dolly" U.S. Pat. No. 3,995,758 dated Dec. 7, 1976.

Applicant's co-pending application, U.S. Ser. No. 578,364, filed May 16, 1975, and entitled "Tension Brush With Adjustable Brake" U.S. Pat. No. 3,972,489 dated Aug. 3, 1976.

Applicant's co-pending application, U.S. Ser. No. 620,319 filed Oct. 7, 1975, and entitled "Supporting Fixtures For Wire-Carrying Spools", U.S. Pat. No. 3,998,403 dated Dec. 2, 1976.

Applicant's co-pending application, U.S. Ser. No. 563,787, filed Mar. 31, 1975, and entitled "Tension Brush For Wire Spool And Method For Making Same" now U.S. Pat. No. 4,017,137 dated Apr. 12, 1977.

Applicant's co-pending application, U.S. Ser. No. 622,025, filed Oct. 14, 1975, and entitled "Quick-Connect Wire Pay-Off Cap Assembly", U.S. Pat. No. 3,997,127.

BACKGROUND

This invention relates generally to wire spooling equipment, and more particularly to devices of the type adapted to facilitate the unreeling of wire from a spool.

Applicant's U.S. Pat. No. 3,425,647 shows a pay-off cap assembly for use with wire-filled spools, comprising a stationary circular tension brush and a freely rotatable wheel having a wheel flange extending over the end of the spool, for engagement with and rotation by a strand of wire being unreeled. The combination of a stationary brush and rotatable wheel has been found to be a very effective means for preventing excessive looseness and kinking of wire, especially under widely varying conditions of wire size and take-off speed.

Such cap assemblies are typically employed with spools several feet in diameter, weighing hundreds of pounds. In the past, the rotatable wheel portion of the cap assembly has been fabricated in steel, often as a single piece. The installation and removal of such cap assemblies involving heavy wheels was frequently difficult for one person to manage. Also, where heavy wheels were employed, their inertia at rest was sometimes too great to be overcome by the strand during initiation of pay out.

Under high speed conditions, the angular momentum developed by a massive steel wheel caused problems if there was a sudden reduction in pay-out speed, in that the wheel continued to rotate at a high speed for a short interval, causing additional unwinding of wire from the spool and leading to excessive looseness in the strand.

Furthermore, there existed a possibility that the wheel would rotate in synchronism with the unreeling strand, especially under constant speeds. This often resulted in a point contact between the wheel and the strand, with the latter also undergoing simultaneous twisting movement as wire was paid off. This had the effect of gouging the wheel at a single point, causing excessive wear, and later on resulting in a tendency for the strand to catch on the wheel each time it passed the worn or gouged point. Such damage at a limited area on the wheel eventually necessitated its replacement, resulting in needless expense and substantial down time.

SUMMARY

The above disadvantages and drawbacks of prior pay-off cap assemblies are obviated by the present invention which has for an object the provision of a novel and improved pay off cap assembly for use with wire filled spools, which is both simple in construction and reliable in operation over extended periods of use. A related object is the provision of a cap assembly which is especially light-weight and thereby is easy to handle, and which enables quick substitution and replacement of parts with a minimum of time and effort. Still another object is the provision of a pay-off cap assembly as above set forth, which is more effective than prior devices under conditions of widely varying pay-off speeds, as far as minimizing excessive looseness and kinking of wire is concerned. Still another object is the provision of a pay-off cap assembly wherein gouging and excessive wear of the wheel is minimized, resulting in improved performance and extended life.

The above objects are accomplished by a novel wire pay-off cap assembly for use with wire-filled, flanged spools to control the unreeling of wire past the ends thereof, comprising a support member, a stationary circular brush carried by the support member and having radially extending tines disposed adjacent the rim of one flange of the spool, and a freely rotatable wheel carried by the support member and constituted of at least two separate pieces, one piece comprising a disk-like body having a bearing at its center for engagement with the support member, and the other of the pieces comprising an annular wheel flange of concave cross-section and having a rounded exterior surface for sliding contact with a strand of wire being unreeled. Means are provided for releasably securing together the body and flange, such that replacement of the latter can be readily accomplished if it should become worn or damaged after prolonged periods of use. Such replacement can be effected without removal of either the circular brush or the wheel body from the support member, resulting in minimum down time and low overall expense.

Other features and advantages will hereinafter appear.

In the drawings illustrating several embodiments of the invention:

Figure 1:
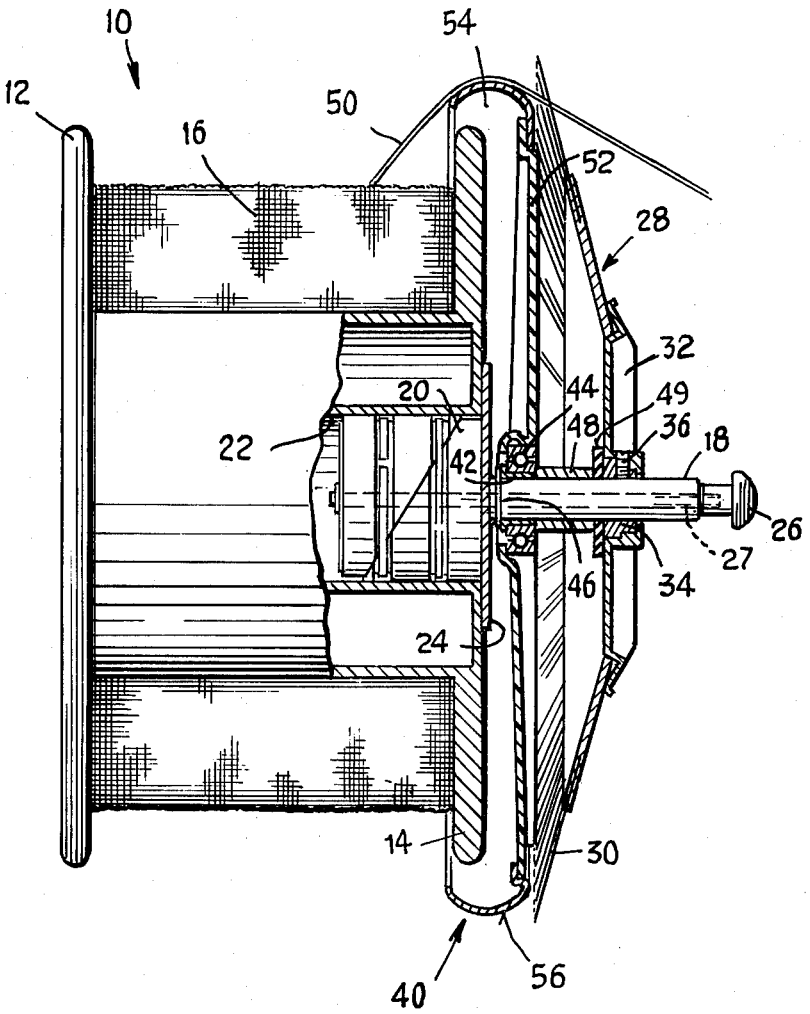
FIG. 1 is a vertical sectional view of a pay out cap assembly having a take-off wheel constructed in accordance with present invention, and showing the assembly mounted at one end of a flanged, wire-filled spool.

Referring first to FIG. 1 there is illustrated a wire-carrying spool 10 having end flanges 12, 14, and being partially filled with a quantity of wire 16. The spool is supported with its axis horizontal, on a sitable rack or other support means (not shown), in order that the flange 14 is raised off the ground a sufficient amount to receive a pay-off cap assembly for facilitating dereeling of wire from the spool. The assembly includes a support member comprising a spindle 18, and a two-part hub 20 which is adapted to be received in the bore 22 of the spool, together with a stop or positioning flange 24 which limits the insertion of the hub 20 into the spool bore. As shown, the spindle 18 is welded to the flange 24, and the latter is in turn welded to one part of the hub 20, so as form a unitary assemblage. The two-part hub 20 is substantially identical in construction to that illustrated and described in my co-pending application, U.S. Ser. No. 622,025 identified above. Installation of the hub is accomplished by manual turning of a nut 26 in FIG. 1, which in turn effects axial movement of a screw 27, resulting in relative lateral shifting of the parts of the hub 20 such that they forcibly engage diametrically opposed portions of the spool bore 22. Further details of the operation can be determined by referring to this co-pending application.

Figure 2:
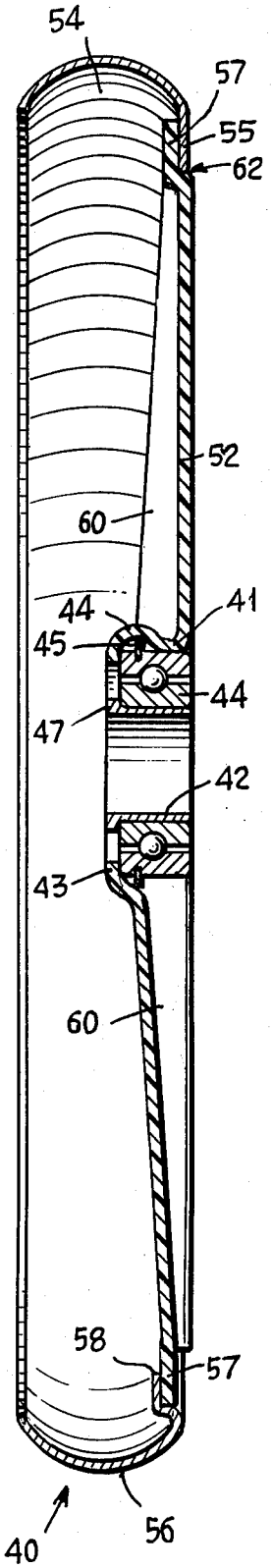
FIG. 2 is an enlarged vertical sectional view of the take-off wheel per se.

The spindle 18 has secured to it a stationary tension brush generally designated 28, including a plurality of radially disposed tines 30 and a central hub 32. The latter is carried on a sleeve 34 and held in place on the spindle by means of a set screw 36. A freely rotatable wheel 40 is carried on a ball bearing 44 having an inner race which is pressed onto a sleeve or sizing bushing 42 having a shoulder 47, the bushing being pressed onto the spindle 18. The wheel 40 has a hub 41 with a through bore, and includes a shoulder 43 engaged by the outer race of the bearing 44. A split retainer ring 45 is received in an annular groove in this outer race, as shown in FIG. 2. During manufacture the hub 41, which is of plastic, is molded around the bearing with the ring 45 being held captive following curing of the part. A retainer washer 46 is received in a groove in the outer surface of the spindle 18 to position the wheel 40 axially. Disposed between the sleeve 42 and sleeve 34 are a spacer 48 and a washer 49 which maintain the wheel 40 and tension brush 28 in spaced relation. As shown, the tines of the latter extend slightly past the periphery of the wheel 40 such that they are brushed by a strand 50 which passes over the wheel periphery and extends to a take-up mechanism (not shown).

Figure 3:
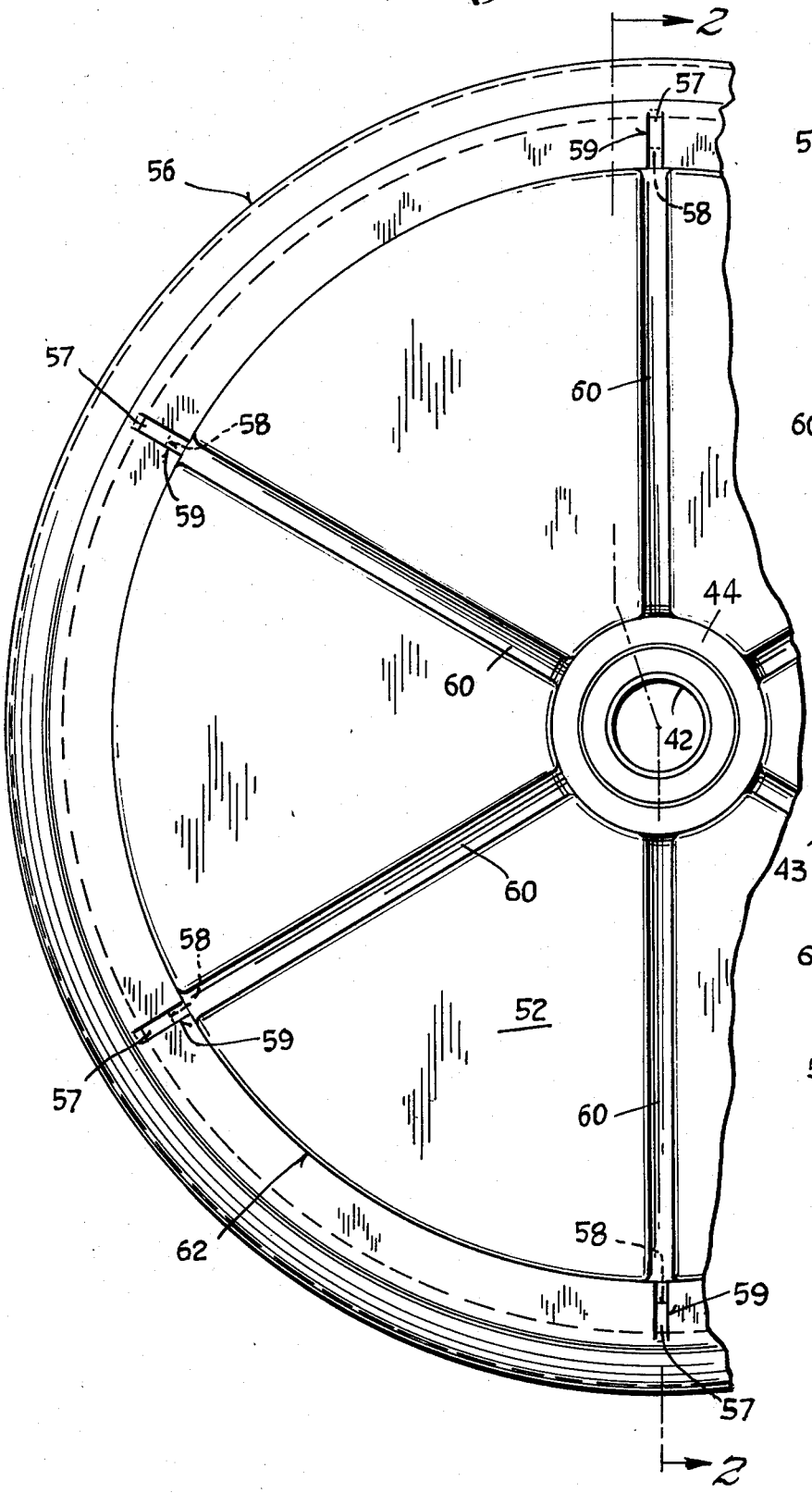
FIG. 3 is a right side elevational view of the wheel of FIG. 2.
Figure 4:
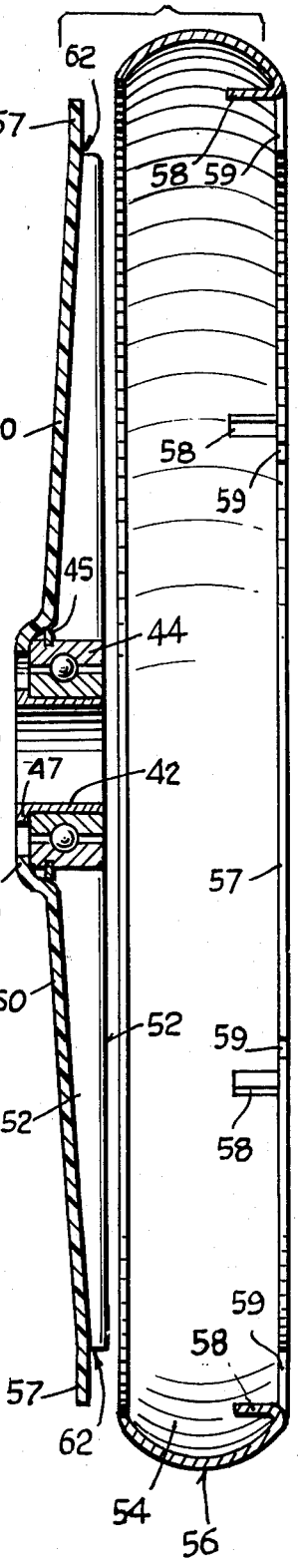
FIG. 4 is an enlarged vertical sectional view of the take-off wheel, particularly showing the method of replacing the flange thereon.

In accordance with the present invention and as shown in FIGS. 2–4, the wheel 40 is constituted as two separate pieces, one piece comprising a disk-like body 52 and the other piece comprising a wheel flange 54 of concave-convex cross-sectional configuration, having an outer curved surface 56 for engagement with the strand of wire being unreeled. Cooperable means are provided on the body 52 and wheel flange 54 for releasably securing the two together. In accomplishing this, the flange 54 includes a series of lugs 58 which are preferably integral with the flange and formed as cut-outs therefrom. Such cut-outs are clearly shown in FIG. 3, and are designated by the numerals 59. During the assembly of the body to the flange as in FIG. 4, the lugs 58 are bent to extend in directions parallel to the axis of the wheel. After the flange is in place, the lugs 58 can be bent radially inward as shown in FIG. 2, such that the flange 54 will be held captive on the body 52. The latter is provided with a series of radially-extending, hollow stiffening ribs 60 which taper from a given dapth to a lesser depth as the wheel periphery is approached, for added stiffness and improved rigidity. As shown in FIGS. 2 and 4, the wheel flange 54 has a cross-sectional configuration similar to the letter J, with the body 55 of the J engaging the periphery or rim 57 of the body 52. The periphery 57 of the wheel body 52 is slightly off-set as shown, thereby defining an annular peripheral recess or circular juncture 62 to receive the wheel flange 54. The ends of the ribs 60 engage the inner peripheral edge of the body 55, to thereby maintain the wheel flange 54 centralized with respect to the body 52.

The body 52 is preferably constituted of molded plastic, with the wheel flange 54 being of anodized aluminum. Such an arrangement provides an extremely light-weight construction, as well as providing a highly abrasion resistant surface 56 for engagement with the wire being unreeled. In addition, I have found that the wire slides easily past the anodized aluminum surface, minimizing the tendency for a strand of wire to gouge the surface in the event that the wheel rotates in synchronism with the strand being unreeled. The light-weight construction is especially important in that it enables the entire cap assembly to be installed, lifted, or removed by a single person, this being important where multiple spools are being employed with a single pay-off cap assembly. Also, under conditions of high pay out speeds, the tendency for the wheel to remain rotating after the wire speed has been suddenly decreased is greatly minimized. Previously, those which were constituted of solid steel tended to remain rotating after the wire speed was decreased, this sometimes resulting in an additional unreeling of several turns of wire from the spool. Such a circumstance has been found to be extremely undesirable, in that it creates excessive looseness, with the possibility of the iwre becoming kinked. Also, the light weight has been found to minimize the inertia effect of a stationary wheel, as pay out of wire begins. Accordingly, the lighter wheel of the present construction begins to rotate much more readily under the action of a strand than would be the case if a solid steel, higher inertia wheel were being employed.

Figure 5:
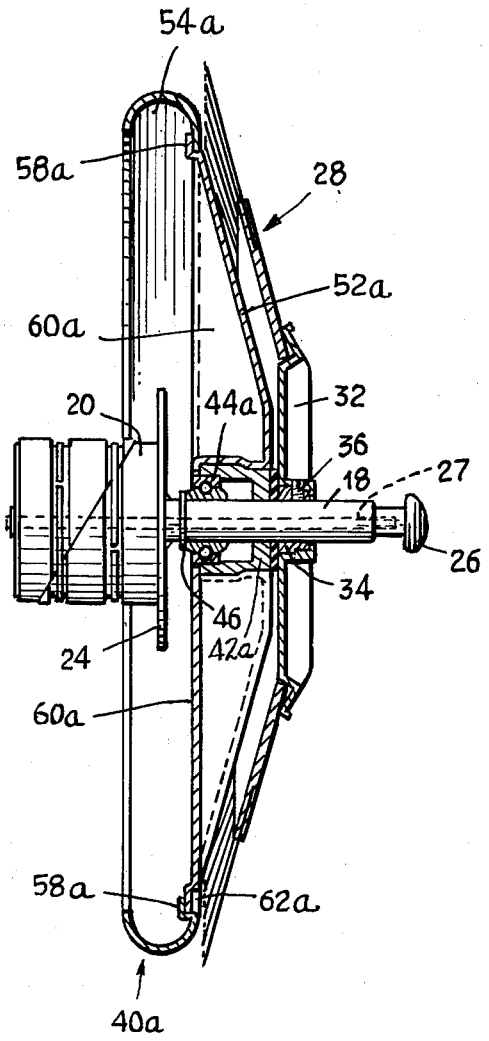
FIG. 5 is a vertical sectional view of a somewhat modified pay out cap assembly, constituting another embodiment of the invention.

Another embodiment of the invention is illustrated in FIG. 5, showing a somewhat modified take-off wheel **40*a* adapted to be substituted for the wheel 40 in the pay-off cap assembly of FIG. 1. The wheel 40*a* is constituted as two separate pieces, a disklike wheel body 52*a* having a conical configuration, and an annular wheel flange 54*a* of concave-convex cross-sectional configuration. The two parts are releasably secured together by means of six lugs 58*a* on the flange, 54*a*, the lugs engaging one side of the body 52*a*. As shown, the latter includes an annular peripheral recess 62*a* which receives the wheel flange 54*a*. The recess 62*a* is formed by an off-set portion of the body 52*a* as in the previous embodiment, and a plurality of ribs 60*a* is provided on the body 52*a* for stiffening the latter. The conical configuration of the body 52 enables the stiffening ribs 60*a* to be somewhat deeper than the ribs 60 of the wheel of the first embodiment, for added rigidity. Disposed at the center of the wheel 40*a* are a sleeve 42*a* and a ball bearing 44*a*, the sleeve directly engaging the spindle 18. The hub 20 and stop flange 24 are rigid with the spindle, as in the prior cap assembly. The tension brush 28** is substantially identical to that already discussed above, in connection with the previous embodiment.

The above constructions have the advantage that in the event it is desired to replace the wheel flange 54 or **54*a*, where the surface thereof has become either damaged or worn, it is only necessary to bend the lugs 58 or 58*a* from the position of FIG. 2, to the position of FIG. 4, remove the wheel flange and install a substitute, and bend the lugs 58 or 58*a* of the new unit radially inward to the position of FIG. 2, in order to retain the two parts together. This can be readily accomplished by one person, with a minimum of time and effort. A certain amount of wear of the exterior surface 56 is inevitable, particularly after prolonged periods of use. Accordingly, periodic replacement of the flange will be necessary, in order that the abraded surface not interfere with the free sliding movement between the surface 56 of the wheel 40** and the strand of wire being unreeled. With steel wire, such abrasion tends to occur more rapidly that with wire constituted of softer material. Clearly, such replacement involves neither special tools, nor special skills or extraordinary strength on the part of the operator.

From the above it can be seen that I have provided a novel and improved pay-off cap assembly for use with wire-carrying spools, incorporating an especially unique take-off wheel with replaceable flange. I have found the above arrangement to be especially effective in minimizing downtime, thus enabling highspeed pay out operation employing multiple spools to be readily realizable. The deivce is thus seen to represent a distinct advance and an improvement in the technology of wire spooling equipment.

Variations and modifications are possible without departing from the spirit of the invention.

I claim:

1. A wire pay-off cap assembly for use with wire-filled, flanged spools to control the unreeling of wire past the ends thereof, comprising in combination:

a. a support member, b. a stationary circular brush carried by said support member and having radially extending tines disposed adjacent the rim of one flange of the spool, and c. a freely rotatable wheel carried by the support member, d. said wheel being constituted of at least two separate pieces, one piece comprising a disk-like body having a bearing at its center for engagement with the support member, and the other of said pieces comprising a wheel flange having an annular exterior surface for sliding contact with a strand of wire being unreeled, and e. cooperable attachment means on the body and wheel flange for releasably securing the two together whereby the flange, when worn or damaged, can be readily replaced without removing the body from the support member.

2. A wire pay-off cap assembly as in claim 1, wherein:

a. the wheel body and wheel flange are fitted to each other along a circular juncture, b. the disk-like body of the wheel being of molded plastic and having a hub provided with a through bore, one end of said hub having an internal annular shoulder, c. an anti-friction ball bearing assemblage molded in said wheel hub, said bearing having inner and outer races and the outer race having annular means locking the bearing in the hub against removal, d. a shouldered plastic sizing bushing disposed in the inner race of said bearing and having a positioning shoulder engaging said race, said bushing fitting to and being engaged and carried by said support member, e. said wheel having a plurality of radial, hollow ribs emanating from said bore and terminating at the circular juncture between the wheel body and the wheel flange, said ribs tapering from a given depth to a lesser depth as the wheel periphery is approached, f. said wheel body having a peripheral annular wall which is offset axially from the remainder of the disk and which provides an annular recess and a circular shoulder defining said recess, g. said wheel flange having an inner peripheral portion engaged with said peripheral wall of the wheel and with said circular wheel shoulder, h. said cooperable attachment means on the wheel body and the wheel flange comprising lugs struck from the inner peripheral portion of the flange and folded radially inward, said peripheral wall of the wheel body being interposed between the inner peripheral portion of the wheel flange and said lugs whereby it is locked in place thereby.

3. The invention as defined in claim 1, wherein:

a. said cooperable attachment means comprises an annular wall on one periphery of the body, and b. a plurality of lugs carried on the flange, extending radially inward and engaging one face of the annular wall of the body, said flange having means engaging the other face of the body wall to thereby hold the parts together.

4. The invention as defined in claim 3, wherein:

a. said lugs are integral with the flange and constituted as metal stampings therefrom.

5. The invention as defined in claim 3, wherein:

a. the flange has the cross-sectional configuration of the letter J, b. said wall of the wheel body being laterally offset from the remainder of the body to provide an annular positioning recess, and the stem of the J being received in said annular recess.

6. The invention as defined in claim 3, wherein:

a. said body has a peripheral portion which is offset in an axial direction away from said circular brush, b. said offset portion defining an annular recess, c. said wheel flange having an inner peripheral portion received and positioned by said recess.

7. The invention as defined in claim 1, wherein:

a. said body is constituted of light-weight plastic, b. said flange being constituted of anodized aluminum providing light-weight and resistance to abrasion.

8. The invention as defined in claim 1, wherein:

a. said body comprises a plurality of radially extending stiffening ribs for minimizing lateral flexing thereof, b. end portions of said ribs engaging the wheel flange to thereby maintain the latter centralized with respect to the body.

9. The invention as defined in claim 1, and further including:

a. means carried by the support member for releasably mounting it at one end of the spool.

* * * * *